United States Patent [19]

Kirsten

[11] 3,987,906

[45] Oct. 26, 1976

[54] APPARATUS FOR PREVENTING THE TILTING OF TELESCOPIC JIB CRANES

[76] Inventor: Erhard Kirsten, Gartenfeldstrasse 17, 5509 Kell, Germany

[22] Filed: Dec. 19, 1974

[21] Appl. No.: 534,638

[30] Foreign Application Priority Data

Jan. 4, 1974 Germany ..... 2400310

[52] U.S. Cl. ..... 212/39 MS; 340/267 C; 212/55; 212/46 R

[51] Int. Cl.[2] ..... B66C 13/48; G08B 21/00

[58] Field of Search ..... 212/39 R, 37, 39 MS, 212/39 A, 86, 132, 55, 46 R; 214/673–674, 1 PZ; 91/412; 340/267 C

[56] References Cited

UNITED STATES PATENTS

| | | | |
|---|---|---|---|
| 3,371,800 | 3/1968 | Grove | 212/39 R |
| 3,641,551 | 2/1972 | Sterner et al. | 340/267 C |
| 3,680,714 | 8/1972 | Holmes | 212/39 A X |
| 3,833,932 | 9/1974 | Hamilton | 340/267 C |
| 3,841,493 | 10/1974 | Jackson et al. | 212/39 MS |
| 3,870,160 | 3/1975 | Hutchings | 212/39 R |

FOREIGN PATENTS OR APPLICATIONS

| | | | |
|---|---|---|---|
| 1,935,791 | 5/1971 | Germany | 212/39 MS |
| 1,138,203 | 10/1962 | Germany | 212/39 R |
| 1,244,358 | 7/1967 | Germany | 212/39 R |
| 1,177,303 | 9/1964 | Germany | 212/39 R |
| 1,162,987 | 2/1964 | Germany | 212/39 MS |

*Primary Examiner*—Robert J. Spar
*Assistant Examiner*—R. B. Johnson
*Attorney, Agent, or Firm*—Parmelee, Miller, Welsh & Kratz

[57] ABSTRACT

Apparatus for preventing the tilting of a telescopic jib crane wherein a hydraulic cylinder is provided for raising the jib. The apparatus includes switches for monitoring the cylinder pressure and the elevation of telescopic position of the jib. Preselected ranges of cylinder pressure are permitted corresponding to predetermined jib elevations and telescopic positions. Above these limits, operations of the crane which would increase the tilting moment are terminated.

2 Claims, 4 Drawing Figures

+
16
17
18
19
23
20
10
11
12
13
14
15
24

Load (tons)
Pressure (atmos.)
Load Limit
Load (tons)
Load Limit
(telescope extended)
Pressure (atmos.)
Load (tons)
(telescope extended)
0 3 6 9 12 15° 18 21 24 27 30° 33 36 39 42 45° 48 51
0 1 2 3 4 5 6 7 8 9 10 11 12 13 14 15 16 17 18 19 20
10 20 30 40 50 100 150

APPARATUS FOR PREVENTING THE TILTING OF TELESCOPIC JIB CRANES

BACKGROUND OF THE INVENTION

1. Field of the Invention

The invention relates to apparatus for preventing the tilting of telescopic jib cranes, especially mobile cranes.

2. Prior Art

The slewing ring of a known mobile crane, together with the frame of the lifting appliance, is mounted on the chassis of the vehicle. The jib is swung upwards about a pivot point by means of a hydraulic cylinder, hereinafter called the "jib-raising cylinder". A further hydraulic cylinder extends and retracts the telescopic jib and is hereinafter called the "telescope cylinder". A winch is used for lifting and lowering the load. Finally, the slewing ring may also be rotated.

When the mobile crane is in use it is stabilized by lateral props which limit the extent to which the crane would tilt if overloaded. To ensure safety during operation of the crane, it is laid down that the return moment counteracting the tilting moment must always be at least 1.4 times the tilting moment. The tilting moment is the product of the load and its leverage. The leverage of the load is at its greatest when the jib is fully lowered, the telescope is extended and the jib is at right angles to the longitudinal axis of the vehicle. Any other movement of the crane reduces the leverage of the arm. The weight of the load which can still be lifted by the crane increases correspondingly.

Various systems are known for limiting the load in dependence upon the position of the various components. In one proposal, the trigonometrical interdependence of the various factors which determine the moment is represented by a cam-plate or the like by which the contacts of an electrical safety switching arrangement are controlled; in this system the magnitude of the load is converted by means functioning in proportion to the load, for example, by a set of laminated spring elements or the like (see "Die Berufsgenossenschaft", No. 10/11, 1958, pages 1–16).

The main disadvantage of the previously proposed safety means resides in the complicated nature of the components thereof and thus in the possibility of their breaking down.

SUMMARY OF THE INVENTION

The present invention provides apparatus for preventing tilting of a telescopic jib crane wherein a hydraulic cylinder is provided for raising the jib, the apparatus comprising means for monitoring the cylinder pressure and the elevation and telescope position of the jib, wherein different ranges of cylinder pressure are permitted corresponding to different elevations and telescope positions of the jib, above which operations of the crane that increase the tilting moment are to be terminated.

The cylinder pressure gives a measure of the load. Taking into consideration the geometry of the crane it is possible in this way to operate the crane successfully with very few monitoring parts and yet to be able to work to just within the safety limit. For example, the apparatus can be incorporated in a crane of the kind having a slewing ring (such as a mobile crane), and the apparatus may be constructed with the least favorable position of a slewing ring of the mobile crane in mind, so that when the slewing ring is rotated, a load that is only slightly below the greatest permissible load can be accepted. The position of the slewing ring therefore does not need to be measured at all.

The apparatus can be constructed to be simple, inexpensive and robust.

The monitoring means may include a plurality of pressure monitors for connection to the cylinder, each monitor having switching contacts actuable on a predetermined pressure being exceeded. The monitoring means may include a plurality of switches, for example, end-position switches for measuring the elevation of the jib and its telescope position. The switching contacts of the pressure monitors may each be connected to a corresponding switch, for example, in series, to provide a signal for causing crane functions to terminate. The switching contacts of the pressure monitors may be connected to an electrical power supply on the crane through switching contacts of appropriate switches and to a control element arranged to terminate crane operations.

Less than 10 end-position switches may suffice as regards the angular position of the jib, and the same may apply in connection with the number of pressure monitors depending upon the constancy of the curvature of the pressure rise in the cylinder with increase in elevation and telescope position; the pressure monitors indicate the dependence of the top load upon the angular position of the jib and upon the position of the telescope. In some instances, a single measuring element for the telescope position that differentiates between the retracted and extended condition will suffice.

BRIEF DESCRIPTION OF THE DRAWINGS

A crane embodying apparatus for preventing the tilting of the crane will now be described, by way of example, with reference to the accompanying drawings, in which.

DESCRIPTION OF THE PREFERRED EMBODIMENT

Figure 1A:
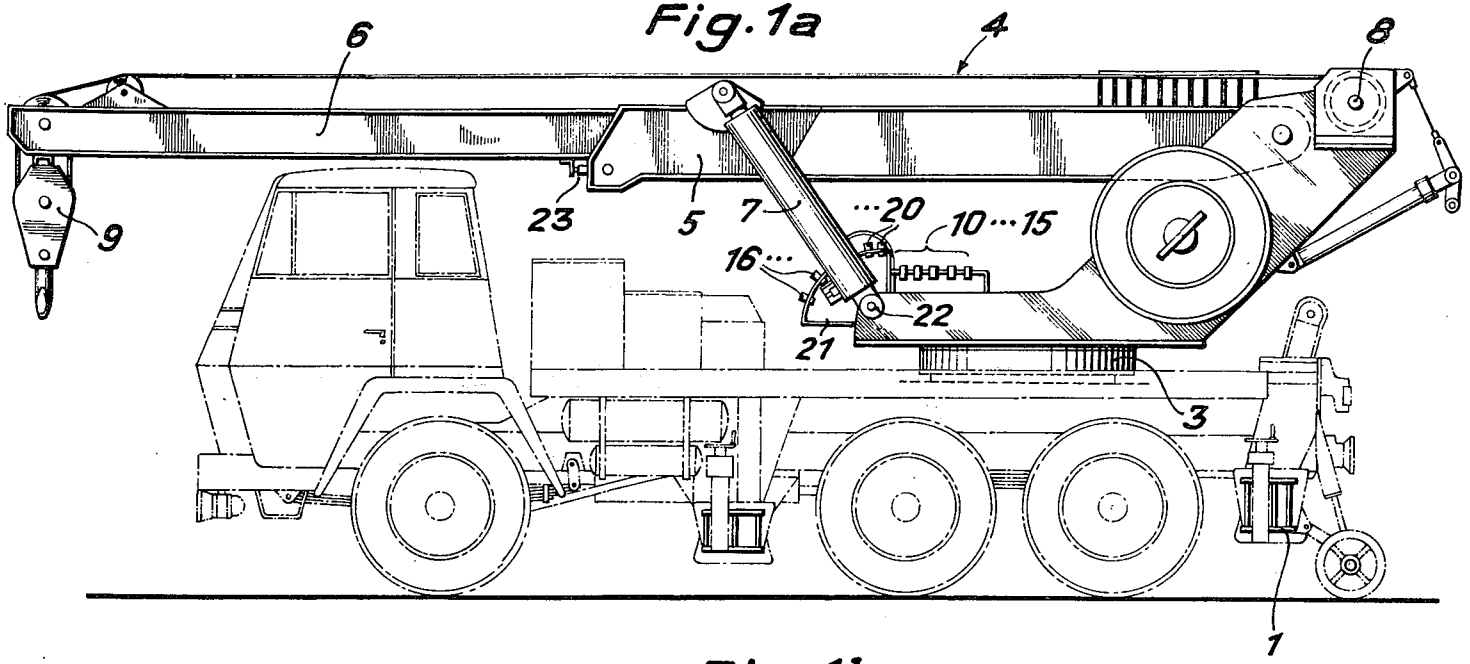
FIGS. 1*a* and 1*b* illustrate diagrammatically the apparatus on a mobile crane.
Figure 1B:
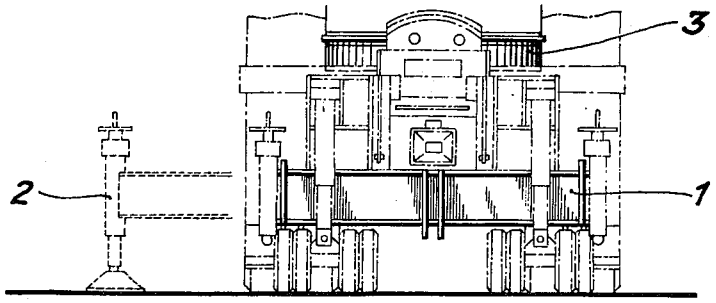

The crane upper structure 4 is mounted to swing about a vertical axis on a vehicle chassis 1 by means of a slewing ring 3, the chassis being provided with props 2. The jib 5 comprising an extensible telescope 6 can be swung about a horizontal pivot 8 by means of a jib-raising cylinder 7. The load is attached to a pulley block 9.

The first group of monitoring elements are pressure monitors 10–15, which are connected to the pressure pipe leading to the jib-raising cylinder. The second group of monitoring elements are switches 16–20, which are secured to a slideway 21 near the foot 22 of the jib-raising cylinder and are actuated by a lug or the like on the jib-raising cylinder when the latter executes swinging movements. The switches 16–20 define angular ranges 0°–11°, 11°–24°, 24°–34°, 34°–45° and 45°–50° of the jib position, these angles each being related to the horizontal.

Finally, the third group of monitoring elements is constituted by a single switch 23 by which it is determined whether the telescope is extended or retracted.

Figures 2, 3:
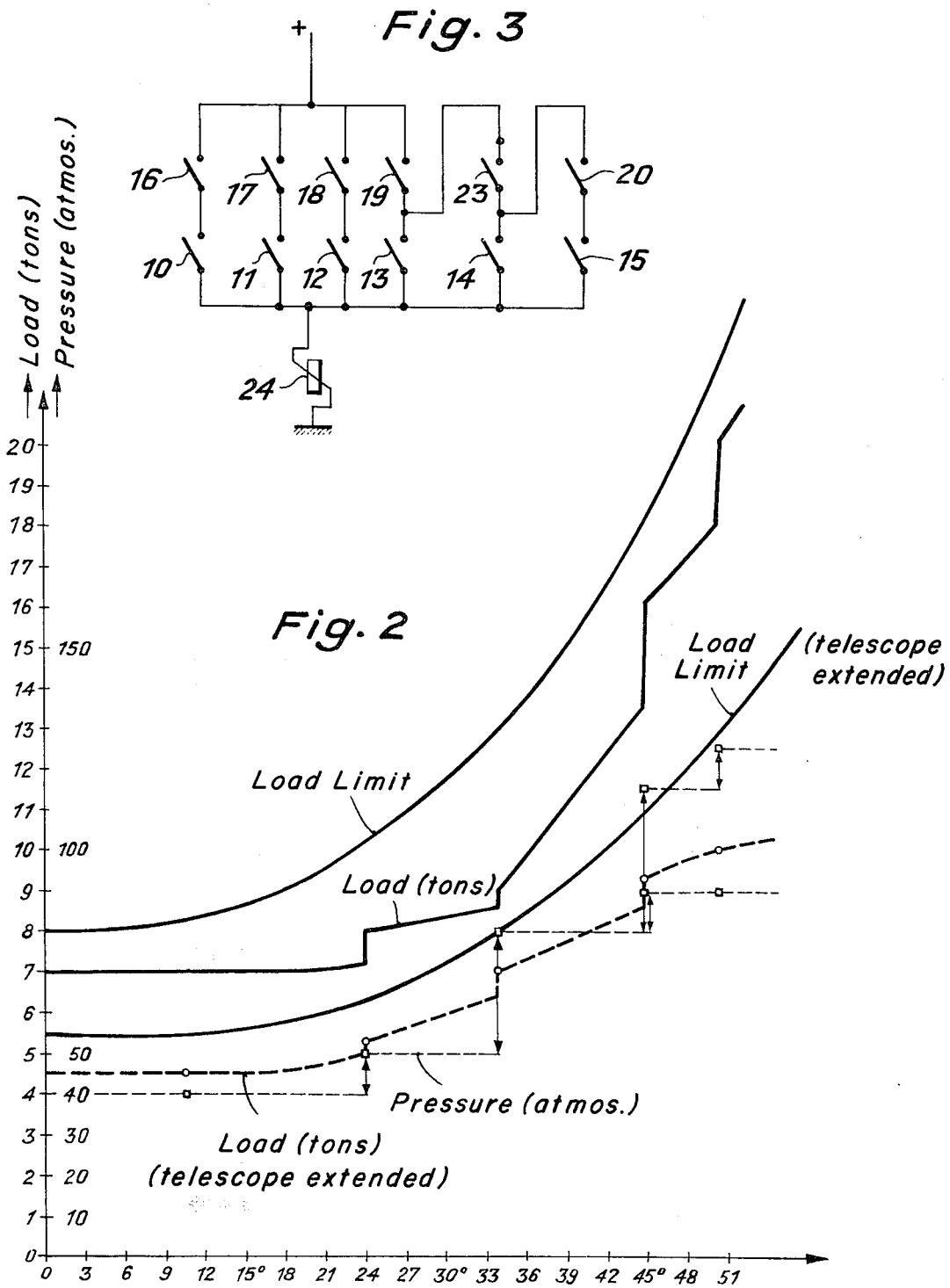
FIG. 2 is an explanatory graph.
FIG. 3 shows partly diagrammatically the circuit diagram for the apparatus seen in FIG. 1.

FIG. 2 shows the permissible load on the pulley block 9 for each particular angular position of the jib 5, the lower curve relating to low load values when the telescope is in the extended position, and the upper curve relating to higher load values when the telescope is in the retracted position.

A particular pressure in the jib-raising cylinder is associated with each load. By means of the circuit to be described by reference to FIG. 3, the entire range of values is divided into two times six subsidiary ranges, in each of which those functions of the crane that increase the tilting moment are stopped as soon as a pre-set load is exceeded. This results in the stepped curves below the limit curves in FIG. 2. Here it will be seen that when the telescope is extended and the jib is raised to the maximum extent — beyond 45° — the permissible load is kept considerably below the theoretical limit. This is associated with the fact that the tilting moment determines only one of the loading limits of a crane. However, the dimensions of the crane are so selected that the mechanical strength of the individual elements of its construction is taken into account in the limiting case. Here it is the buckling strength of the telescope which inhibits maximum loading of the crane when the telescope is extended.

On the basis of the geometry of the crane it is possible to use the same pressure monitor irrespective of whether the telescope is extended or not, with the exception of the above-mentioned limiting range for the buckling strength of the telescope, for which an additional pressure monitor is required. From this are obtained the values for the actuating pressure in the jib-raising cylinder that are indicated at the various steps.

Moreover, the geometrical design of the crane is such that the loads can increase fairly steadily as the jib is raised, and that the associated pressures in the jib-raising cylinder also steadily increase. Particularly simple switching circuits, as illustrated in FIG. 3 for example, therefore suffice.

The monitoring circuit shown in FIG. 3 is a steady-current circuit which keeps the control element, constituted by a relay 24, energized as long as the tilting moment is not reached. The pressure monitors 10–15 switch off at the following pressures:

| | |
|---|---|
| 10: | 40 atmos. |
| 11: | 50 atmos. |
| 12: | 80 atmos. |
| 13: | 90 atmos. |
| 14: | 115 atmos. |
| 15: | 120 atmos. |

switch 16 is closed in the range 0°–24°,
switch 17 is closed in the range 24°–34°,
switch 18 is closed in the range 34°–45°,
switch 19 is closed in the range beyond 45°, and
switch 20 is closed in the range beyond 50°.

In the lower positions of the jib, the switches are open. In the higher positions they can be open or closed.

Accordingly, the pressure in the jib-raising cylinder must be below 40 atmos. in the range 0° to 24°; at a higher load the relay 24 does not conduct current, and so on.

The telescope switch 23 blocks the flow of current through the pressure monitors 14 and 15 and thus limits the jib-raising cylinder pressure to 90 atmos. when the telescope is extended. When the telescope is retracted, the switch 23 is closed; there are then two further ranges: a pressure of 115 atmos. corresponding to a load of 16 tonnes, and a pressure of 120 atmos. corresponding to a load of 20 tonnes, limited by the switches 19 and 20 respectively. The telescope switch however should permit these higher pressures only beyond 45°. For this reason the switch 19 does not switch off beyond 50° but remains closed, and the switch 23 is connected after the switch 19.

Not all the functions of the crane are stopped by the relay 24, but only those that increase the tilting moment, i.e. actuation of the telescope cylinder, lowering of the jib, raising of the pulley block by the winch, and rotation of the slewing ring. The manner of achieving this by actuating the relay 24 will be familiar to the person skilled in the art and does not required to be described in detail.

What I claim is:

1. An overload prevention system for preventing tilting of a telescopic jib crane in which a hydraulic cylinder is provided for raising the jib, said system comprising an electric power supply, a control element arranged to terminate crane operation when deenergized and a steady-current circuit for connecting said control element to said electric power supply as long as the tilting moment of the crane is not reached, said circuit including a plurality of switching contacts belonging to pressure monitors connected with the hydraulic cylinder which switching contacts sequentially switch off with increasing predetermined pressure values of the cylinder pressure, and a plurality of switches monitoring the angular elevation position and the telescope position of the jib which switches are closed upon reaching a predetermined position, said switching contacts being connected to said control element through said switches, the improvement wherein said switches includes a telescoping switch which is closed when the telescoping jib is retracted and is open otherwise and an additional set of switching contacts belonging to a pressure monitor connected with the hydraulic cylinder which switching contacts do not open until a higher cylinder pressure is reached than that at which all of said first mentioned switching contacts open and means connecting said telescoping switch, and the additional set of switching contacts with the electric power supply, the angular position switch which closes for the highest range of angular elevation of the jib and the control element whereby a larger load can be supported by the crane at the higher angle of elevation when the telescoping jib is retracted without terminating crane operations through deenergization of the control element.

2. The system of claim 1 including an additional angular position switch which closes for the upper portion of the range of angular elevation of the jib associated with the highest angular position switch, another set of switching contacts belonging to a pressure monitor connected with the hydraulic cylinder which switching contacts open at a pressure higher than that at which said additional set of switching contacts opens, and means connecting the additional angular position switch and the another set of switching contacts with the electric source, the angular position switch associated with the highest elevation of the jib, the telescoping switch and the control element whereby additional load can be supported by the crane at the highest angle of elevation when the telescoping jib is retracted without terminating crane operations through deenergization of the control element.

* * * * *